US006983193B2

(12) United States Patent
Mizuno et al.

(10) Patent No.: US 6,983,193 B2
(45) Date of Patent: Jan. 3, 2006

(54) APPARATUS AND PROGRAM STORED ON A COMPUTER READABLE MEDIUM FOR PROCESSING EMBROIDERY DATA

(75) Inventors: Masahiro Mizuno, Nagoya (JP); Yukiyoshi Muto, Nagoya (JP); Mikitoshi Suzuki, Nagoya (JP); Shoichi Taguchi, Nagoya (JP); Akihiro Wakayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/046,760

(22) Filed: Feb. 1, 2005

(65) Prior Publication Data

US 2005/0234584 A1 Oct. 20, 2005

(30) Foreign Application Priority Data

Mar. 30, 2004 (JP) ..... 2004-100640

(51) Int. Cl.
*G06F 19/00* (2006.01)
*D05C 5/02* (2006.01)

(52) U.S. Cl. ..... 700/138; 112/102.5

(58) Field of Classification Search ..... 700/138, 700/136, 137; 112/102.5, 470.06, 470.01, 112/475.19
See application file for complete search history.

(56) References Cited

U.S. PATENT DOCUMENTS 5,960,727 A * 10/1999 Miyasako et al. ..... 112/102.5
6,256,551 B1 7/2001 Muto
6,600,966 B1 * 7/2003 Bailie ..... 700/138

FOREIGN PATENT DOCUMENTS

JP A 11-57260 3/1999
JP A 2000-24350 1/2000

* cited by examiner

*Primary Examiner*—Peter Nerbun
(74) *Attorney, Agent, or Firm*—Oliff & Berridge, PLC

(57) ABSTRACT

The disclosed apparatus and program stored on a computer readable medium for processing embroidery data make stitch data subdivisions into which the stitch data was divided, according to the size of partitions, and add partition position information corresponding to the position of stitch data subdivision in the stitch data to the stitch data subdivisions. If the size of an embroidery pattern which is embroidered by the embroidery data is greater than a predetermined workable area of sewing within the embroidery frame, the embroidery data is divided into subdivisions and where the embroidery data subdivisions is positioned in the whole embroidery design can be identified.

25 Claims, 10 Drawing Sheets

APPARATUS AND PROGRAM STORED ON A COMPUTER READABLE MEDIUM FOR PROCESSING EMBROIDERY DATA

BACKGROUND OF THE INVENTION

1. Field of the Invention

The present invention relates to an apparatus for processing embroidery data and a program stored on a computer readable medium for processing embroidery data by which the sewing of an embroidery pattern is performed by an embroidery sewing machine, using an embroidery frame, and, more particularly, to the manipulation of the embroidery data, if the embroidery pattern that is embroidered in accordance with the embroidery data is larger than a predetermined workable area of sewing within the embroidery frame.

2. Description of Related Art

An embroidery sewing machine is arranged to perform embroidery in accordance with embroidery data and furnished with an apparatus for processing the embroidery data, based on shape data that represents the shape of a pattern to be embroidered. The embroidery data processing apparatus is comprised, e.g., a general-purpose personal computer system and peripherals such as an image scanner, hard disk drive, keyboard, and CRT display which are connected to the computer system. In the embroidery data processing apparatus, the shape data is obtained by reading it from, e.g., a hard disk, and extracting it from image data generated by having an original picture scanned by the image scanner.

Using the shape data thus obtained, embroidery is performed on a cloth secured in the embroidery frame. If the size of a pattern that is embroidered in accordance with the embroidery data is larger than a predetermined workable area of sewing within the embroidery frame, the embroidery cannot be performed. For such a large embroidery pattern that is greater than the predetermined workable area of sewing within the embroidery frame, conventionally, the following method has been taken: dividing the embroidery pattern into parts falling within the workable area of sewing; generating embroidery data for each part of the pattern; and finally combining all the parts into the embroidery pattern.

Contrivances relating to the embroidery data processing apparatus that divides an embroidery pattern greater than a given workable area of sewing into parts falling within the workable area of the embroidery sewing machine and generates divisional embroidery data are described in Japanese patent application laid-open publication No. H11-57260 (1999-57260) and Japanese patent application laid-open publication No. 2000-24350.

The embroidery data processing apparatus described in the above publications is able to embroider even such a large embroidery pattern by dividing it into a sewing region falling within the maximum size of sewing by the embroidery sewing machine. However, in this method, when a large embroidery pattern is divided into a number of sewing sections, it is very difficult to identify what position of the section that the user is going to work is in the whole embroidery pattern. This posed a problem in which, unless the user can identify what position of a sewing region that the user is going to work, the user has to retry placing and securing the embroidery medium in the embroidery frame again and again, which would be troublesome.

SUMMARY OF THE INVENTION

The object of the present invention which has been made in view of the above-described problem is to provide an apparatus and a program stored on a computer readable medium for processing embroidery data, allowing for embroidering a large embroidery pattern that is greater than sewing area within which the embroidery sewing machine is able to do sewing by dividing the embroidery pattern into a plurality of partitions and allowing for identifying the position of a pattern subdivision in a partition where the embroidery sewing machine is now doing the sewing in the whole embroidery pattern.

To achieve the purpose of the invention, there is provided an apparatus for processing embroidery data including a control unit which manipulates embroidery data by which the sewing of an embroidery pattern is performed using an embroidery sewing machine, wherein the control unit comprises: a processor which performs the following process comprising: a process of obtaining partition information that specifies the bounds of a partition for a plurality of partitions into which the embroidery data is divided, a process of making embroidery data subdivisions by dividing the embroidery data into subdivisions, according to the partition information, and a process of generating partition position information that indicates the position of the embroidery data subdivisions in the whole embroidery data; and a display device which displays a pattern layout and the location of an embroidery data subdivision in the whole embroidery data, based on the partition position information for the embroidery data subdivisions.

The apparatus for processing embroidery data makes embroidery data subdivisions into which the embroidery data was divided, according to partition information for specifying the bounds of partitions. The apparatus generates partition position information indicating the position of embroidery data subdivision in the whole embroidery data. Furthermore, the apparatus displays a design layout and the location of an embroidery data subdivision in the whole embroidery data on the display device, based on the partition position information for the embroidery data subdivisions. Consequently, even when the sewing is performed from a number of embroidery data subdivisions, what partition where the sewing is now being performed can be identified easily by seeing the partition position information displayed on the display device.

According to another aspect, the present invention provides an apparatus for processing embroidery data including a control unit which manipulates embroidery data by which the sewing of an embroidery pattern is performed using an embroidery sewing machine and allowing for connection to a printer, wherein the control unit comprises a processor which performs the following process comprising: a process of obtaining partition information that specifies the bounds of a partition for a plurality of partitions into which the embroidery data is divided; a process of making embroidery data subdivisions by dividing the embroidery data into subdivisions, according to the partition information; and a process of making a template of partitions with markers indicating relative positions of the embroidery data subdivisions in the whole embroidery data, based on the embroidery data subdivisions, and generating print data for printing the template by the printer.

Together with making embroidery data subdivisions by dividing the embroidery data into a plurality of partitions, the apparatus makes and prints a template of partitions with markers for setting a cloth aligned with each of the partitions, when embroidering by the embroidery data subdivisions in the whole embroidery data. Consequently, when embroidering the whole embroidery data by partition, the cloth can be set aligned with each partition with ease.

According to another aspect, the present invention provides an apparatus for processing embroidery data including a control unit which manipulates embroidery data by which the sewing of an embroidery pattern is performed using an embroidery sewing machine and allowing for connection to a printer, wherein the control unit comprises a processor which performs the following process comprising: a process of obtaining partition information that specifies the bounds of a partition for a plurality of partitions into which the embroidery data is divided; a process of making embroidery data subdivisions by dividing the embroidery data into subdivisions, according to the partition information; a process of generating print data for printing pattern figure sections corresponding to the embroidery data subdivisions, based on the embroidery data subdivisions using the printer; a process of making print data subdivisions for a part of the embroidery data subdivisions, if it is impossible to print the whole print data on the print medium, when printing the print data in full scale by the printer; and a process of adding print subdivision position information indicating the position of the print data subdivisions in the whole print data to the print data subdivisions.

Together with making embroidery data subdivisions into which the embroidery data was divided, the apparatus generates print data for printing pattern figure sections corresponding to the embroidery data subdivisions. When printing the print data in full scale, if it is impossible to print the whole print data on the print medium, the apparatus makes print data subdivisions for a part of the embroidery data subdivisions and adds print subdivision position information indicating the position of the print data subdivisions in the whole print data to the print data subdivisions. Consequently, by arranging the sheets of the print medium having exact-sized prints of the embroidery pieces prior to sewing, it becomes easy to predict the whole embroidery pattern that will be completed. Furthermore, using the position information printed, the work of arranging the sheets can be performed readily.

According to another aspect, the present invention provides an apparatus for processing embroidery data including a control unit which manipulates embroidery data by which the sewing of an embroidery pattern is performed using an embroidery sewing machine and allowing for connection to a printer which prints on a print medium, wherein the control unit comprises a processor which performs the following process comprising: a process of obtaining partition information that specifies the bounds of a partition for a plurality of partitions into which the embroidery data is divided; a process of making embroidery data subdivisions by dividing the embroidery data into subdivisions, according to the partition information; a process of making print data subdivisions for printing pattern figure pieces corresponding to a part of pattern figure sections by the printer, if it is impossible to print the whole pattern figure section on the print medium, when printing the pattern figure sections corresponding to the embroidery data subdivisions in full scale by the printer; and a process of adding print subdivision position information indicating the position of the pattern figure pieces in the whole design layout section to the print data subdivisions.

When printing the pattern figure sections corresponding to the embroidery data subdivisions in full scale, if it is impossible to print the whole pattern figure section on the print medium, the apparatus makes print data subdivisions for pattern figure pieces corresponding to a part of the pattern figure sections and adds print subdivision position information indicating the position of the pattern figure pieces in the whole pattern figure section to the print data subdivisions. Consequently, by arranging the sheets of the print medium having exact-sized prints of the embroidery pieces prior to sewing, it becomes easy to predict the whole embroidery pattern that will be completed. Furthermore, using the position information printed, the work of arranging the sheets can be performed readily.

According to another aspect, the present invention provides a program stored on a computer readable medium for processing embroidery data which is executed on a control unit which manipulates the embroidery data by which the sewing of an embroidery pattern is performed using an embroidery sewing machine, wherein the program comprises instructions for causing a processor installed in the control unit to perform the following process comprising: a step of obtaining partition information that specifies the bounds of a partition for a plurality of partitions into which the embroidery data is divided; a step of making embroidery data subdivisions by dividing the embroidery data into subdivisions, according to the partition information; a step of generating partition position information that indicates the position of the embroidery data subdivisions in the whole embroidery data; and a step of adding the partition position information to the embroidery data subdivisions.

By executing the program stored on a computer readable medium for processing embroidery data on a computer, the computer divides the embroidery data into subdivisions, according to the partition information that specifies the bounds of a partition for a plurality of partitions into which the embroidery data is divided, thus making embroidery data subdivisions, and generates partition position information that indicates the position of the embroidery data subdivisions in the whole embroidery data. Then, the computer adds the partition position information to the embroidery data subdivisions. Consequently, because the partition position information corresponding to the embroidery data subdivisions is added to each embroidery data subdivision, where each embroidery data subdivision is positioned in the whole embroidery data can be identified.

According to another aspect, the present invention provides a program stored on a computer readable medium for processing embroidery data which is executed on a control unit which manipulates the embroidery data by which the sewing of an embroidery pattern is performed using an embroidery sewing machine and print data which is sent to and printed by a printer, wherein the program comprises instructions for causing a processor installed in the control unit to perform the following process comprising: a step of obtaining partition information that specifies the bounds of a partition for a plurality of partitions into which the embroidery data is divided;

a step of making embroidery data subdivisions by dividing the embroidery data into subdivisions, according to the partition information; and a step of making a template of partitions with markers for setting a cloth aligned with the partitions, when embroidering the whole embroidery data based on the embroidery data subdivisions, and generating print data for printing the template by the printer.

By executing this program on the computer, the computer makes embroidery data subdivisions by dividing the embroidery data into a plurality of partitions. The computer can make a template of partitions with markers for setting a cloth aligned with the partitions, when embroidering by the embroidery data subdivisions in the whole embroidery data. Consequently, when embroidering the whole embroidery data by partition, by printing the template of partitions, the cloth can be set aligned with each partition with ease.

According to another aspect, the present invention provides a program stored on a computer readable medium for processing embroidery data which is executed on a control unit which manipulates the embroidery data by which the sewing of an embroidery pattern is performed using an embroidery sewing machine and print data which is sent to and printed by a printer, wherein the program comprises instructions for causing a processor installed in the control unit to perform the following process comprising: a step of obtaining partition information that specifies the bounds of a partition for a plurality of partitions into which the embroidery data is divided; a step of making embroidery data subdivisions by dividing the embroidery data into subdivisions, according to the partition information; a step of generating print data for printing pattern figure sections corresponding to the embroidery data subdivisions, based on the embroidery data subdivisions, using the printer; a step of making print data subdivisions for a part of the embroidery data subdivisions, if it is impossible to print the whole print data on the print medium, when printing the print data in full scale by the printer; and a step of adding print subdivision position information indicating the position of the print data subdivisions in the whole print data to the print data subdivisions.

By executing this program on the computer, the computer divides the embroidery data into subdivisions, according to the partition information that specifies the bounds of partitions, and generates print data for printing the pattern figure sections corresponding to the embroidery data subdivisions. When printing the print data in full scale, if it is impossible to print the whole print data on the print medium, the computer makes print data subdivisions for parts of the embroidery data subdivisions and adds print subdivision position information indicating the position of the print data subdivisions in the whole print data to the print data subdivisions. Consequently, by arranging the sheets of the print medium having exact-sized prints of the embroidery pieces prior to sewing, it becomes easy to predict the whole embroidery pattern that will be completed. Furthermore, using the position information printed, the work of arranging the sheets can be performed readily.

According to another aspect, the present invention provides a program stored on a computer readable medium for processing embroidery data which is executed on a control unit which manipulates the embroidery data by which the sewing of an embroidery pattern is performed using an embroidery sewing machine and print data which is sent to and printed by a printer, wherein the program comprises instructions for causing a processor installed in the control unit to perform the following process comprising: a step of obtaining partition information that specifies the bounds of a partition for a plurality of partitions into which the embroidery data is divided; a step of making embroidery data subdivisions by dividing the embroidery data into subdivisions, according to the partition information; a step of making print data subdivisions for printing pattern figure pieces corresponding to a part of pattern figure sections by the printer, if it is impossible to print the whole pattern figure section on the print medium, when printing the pattern figure sections corresponding to the embroidery data subdivisions in full scale by the printer; and a step of adding print subdivision position information indicating the position of the pattern figure pieces in the whole pattern figure section to the print data subdivisions.

By executing this program on the computer, the computer divides the embroidery data into subdivisions, according to the partition information that specifies the bounds of partitions. When printing the pattern figure sections corresponding to the embroidery data subdivisions in full scale, if it is impossible to print the whole pattern figure section on the print medium, the computer makes print data subdivisions for pattern figure pieces corresponding to parts of the pattern figure sections. Then, the computer adds print subdivision position information indicating the position of the pattern figure pieces in the whole embroidery pattern section to the print data subdivisions. Consequently, by arranging the sheets of the print medium having exact-sized prints of the embroidery pieces prior to sewing, it becomes easy to predict the whole embroidery pattern that will be completed. Furthermore, using the position information printed, the work of arranging the sheets can be performed readily.

DETAILED DESCRIPTION OF THE PREFERRED EMBODIMENTS

The apparatus for processing embroidery data and a program stored on a computer readable medium for this purpose, according to the present invention, will be discussed fully hereinafter, using its illustrative embodiment, an embroidery data processing apparatus 1, and referring to the accompanying drawings.

Figure 1:
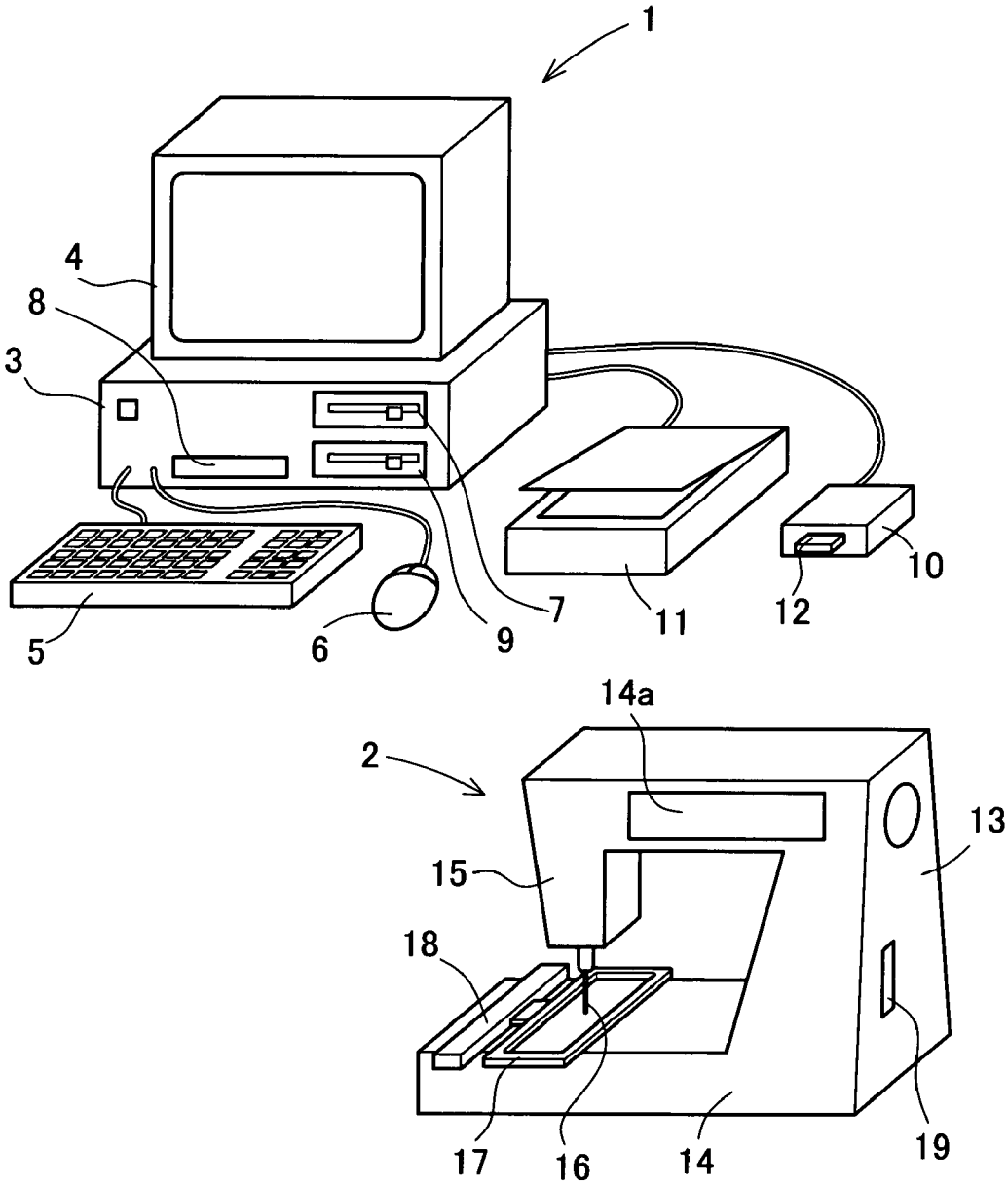
FIG. 1 is a schematic of the apparatus for processing embroidery data according to a preferred embodiment of the invention.

First, FIG. 1 shows the arrangements of the embroidery data processing apparatus 1 and an embroidery sewing machine 2 as the sewing equipment that performs embroidery in accordance with embroidery data generated by the embroidery data processing apparatus 1. In FIG. 1, the embroidery data processing apparatus 1 primarily has a computer main frame 3. The computer main frame 3 is equipped with a display 4 which displays images, figures, characters, etc. Besides, the following are connected to the computer main frame 3: a keyboard 5 and a mouse 6 which are used to enter a point and select a menu item; a flexible disk drive 7 and a hard disk drive 8 for storing image data, figure data, stitch data, etc. and retrieval thereof; a CD-ROM drive 9 from which a stitch data dividing program or the like, which will be described later, is retrieved, this program being installed on the embroidery data processing apparatus 1; a flash memory device 10 which writes stitch data into a removable memory card 12 which consists of a nonvolatile flash memory; and an image scanner 11 for scanning an original pattern into the computer.

On the other hand, the main body 13 of the embroidery sewing machine 2 consists of an upper arm portion 15 and a lower bed portion 14 which are integrally manufactured. On the end of the arm portion 15, a needle bar (not shown) with a sewing needle 16 is installed. On the bed portion 14, an embroidery frame 17 which fastens a work cloth (not shown) to be embroidered is placed. The embroidery frame 17 is arranged to be moved to an arbitrary position, based on an X-Y coordinate system intrinsic to the apparatus, by an embroidery frame movement mechanism 18.

On the right side of the machine's main body 13, an insertion slot 19 into which the memory card 12 will be inserted is provided. In the overhang part of the bed portion 14, a display panel consisting of a small liquid crystal display or the like is provided.

The embroidery sewing machine 2 is arranged to be given stitch data externally from the memory card 12. Thus, the embroidery sewing machine 2 embroiders a predetermined pattern on the work cloth by driving the needle bar and a shuttle mechanism (not shown), while the embroidery frame movement mechanism 18 moves the work cloth smoothly in accordance with data that specifies the distances of movement of the work cloth to be embroidered (stitch positions) in X and Y directions per stitch, which constitutes the stitch data.

The embroidery data processing apparatus 1 of the present embodiment has the function to generate stitch data by which the embroidery sewing machine 2 can perform sewing in this way.

Figure 2:
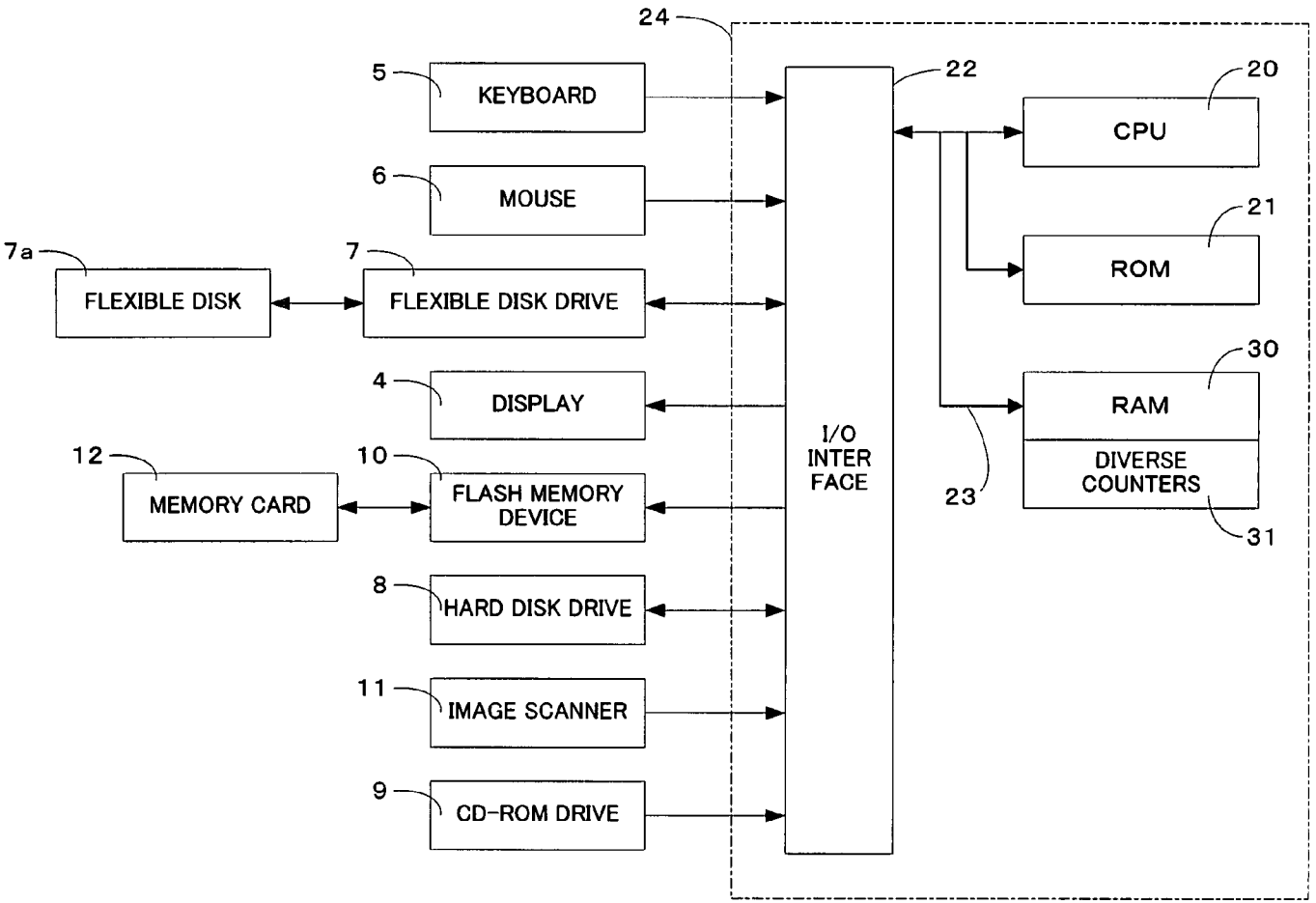
FIG. 2 is a block diagram of the control system of the embroidery data processing apparatus of the present embodiment.

Next, the arrangement of the control system of the embroidery data processing apparatus 1 will be described in detail with reference to the relevant drawing. FIG. 2 is a block diagram of the control system of the embroidery data processing apparatus 1 of the present embodiment.

As shown in FIG. 2, a control unit 24 is built in the computer main frame 3. The following are connected to an I/O interface 22 of this control unit 24: the display 4, keyboard 5, mouse 6, flexible disk drive 7, flash memory device 10, hard disk drive 8, image scanner 11, and CD-ROM drive 9.

The control unit 24 is comprised of a CPU 20, the I/O interface 22 connected to the CPU 20 via a bus 23 such as a data bus, ROM 21, and RAM 30. Control programs for different functions such as the stitch data dividing process which will be described later are stored in the ROM 21.

The following are stored in the RAM 30: graphic data comprising the contours of planar figures and the shape lines of linear figures; stitch data generated, based on the figure data; partitions corresponding to a plurality of sewing sections; stitch data subdivisions generated by dividing the stitch data, according to the partitions.

Moreover, information about the partitions is stored, including the number of partitions, the maximum size of horizontal sewing by the machine, which is the maximum range within which the machine does sewing in the horizontal direction, the maximum size of vertical sewing by the machine, which is the maximum range within which the machine does sewing in the vertical direction, a horizontal overlap margin between adjacent partitions in the horizontal direction, and a vertical overlap margin between adjacent partitions in the vertical direction.

Furthermore, the RAM 30 provides for the storage areas for diverse counters 31 which are used in the process of dividing stitch data, which will be described later.

Prior to the process of making stitch data subdivisions, the maximum size of horizontal sewing by the machine, the maximum size of vertical sewing by the machine, the horizontal partition overlap margin, and the vertical partition overlap margin, which have been stored in advance in the ROM 21, are read from the ROM 21. Alternatively, these items of information stored in a flexible disk 7*a* are read by the flexible disk drive 7, stored in a hard disk are read by the hard disk drive 8, or stored in a CD-ROM by the CD-ROM drive 9. The thus read data of the maximum size of horizontal sewing by the machine, the maximum size of vertical sewing by the machine, the horizontal partition overlap margin, and the vertical partition overlap margin are stored into the RAM 30.

The flexible disk drive 7 is configured such that the flexible disk 7*a*, a recording medium having image data, shape data, stitch data, etc. stored thereon is set removably in it. The hard disk drive 8 stores and retrieves various types of data such as image data, shape data, and stitch data and programs for different functions such as the stitch data dividing program, which will be described later, into and from the hard disk. The CD-ROM drive 9 retrieves the programs for different functions such as the stitch data dividing program stored in the CD-ROM and installed on the embroidery data processing apparatus 1 and various types of data from the CD-ROM. The stitch data dividing program will be discussed later. The flash memory device 10 in which the memory card 12 consisting of a nonvolatile flash memory is set removable is used to write stitch data into the memory card 12. The image scanner 11 is used to scan an embroidery pattern original into the computer.

Figure 3:
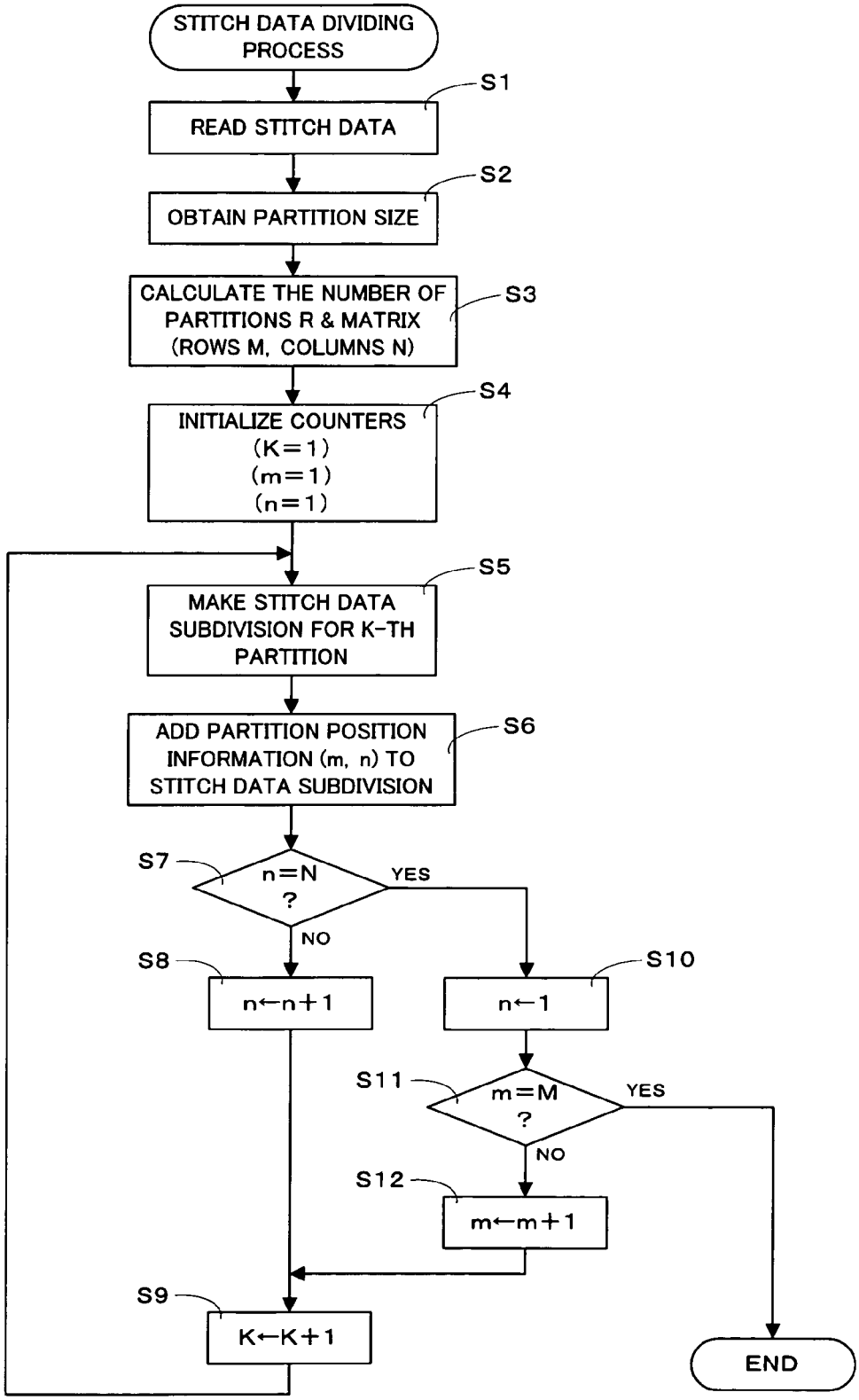
FIG. 3 is a flowchart of a stitch data dividing program that is executed in the present embodiment.
Figure 4:
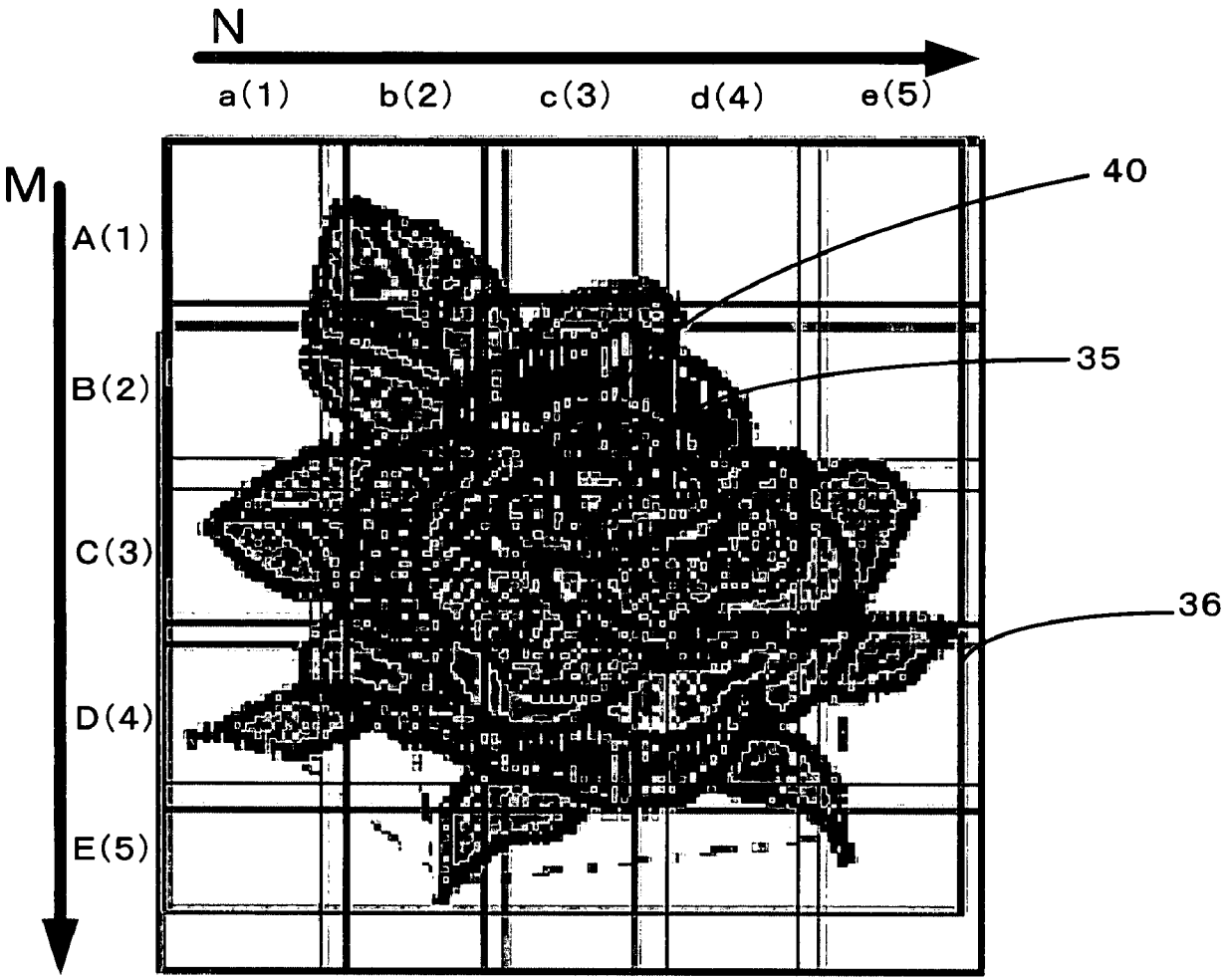
FIG. 4 is an illustration to explain the process of dividing stitch data in the present embodiment.

Next, the process of making stitch data subdivisions, in other words, the process of dividing stitch data, which is performed by the control unit 24 of the embroidery data processing apparatus 1, will be described in detail with reference to FIG. 3 or FIG. 4. FIG. 3 is a flowchart of the stitch data dividing program which is executed by the embroidery data processing apparatus 1 of the present embodiment. FIG. 4 is an illustration to explain dividing the stitch data.

When the stitch data dividing process starts by a start command entered, using the keyboard 5 or the mouse 6, first, the stitch data is read from the RAM 30 (step S1).

This step reads the stitch data 36 stored in the RAM 30 after reading the shape data (representing the contour of a closed region and/or shape lines such as straight lines or curves) stored in advance on a storage medium such as the flexible disk 7*a* or hard disk by the flexible disk drive 7, hard disk drive 8, and the like, or after being generated by extracting the shape data from image data generated by having the original scanned by the image scanner 11. After finishing the step of reading the stitch data 36 (S1), the process proceeds to step S2.

In step S2, data for the size of a partition 35 is obtained. In the present embodiment, after reading the partition 35 data comprising the horizontal size and vertical size of the partition and the horizontal and vertical partition overlap margins stored in advance in the ROM 21, flexible disk 7*a* or CD-ROM, the partition data is transferred into the RAM 30, or the partition data entered by the user with the keyboard 5 and mouse 6 is stored into the RAM 30. In step S2, the partition 35 size information is retrieved from the RAM 30.

After retrieving the partition 35 size information (S2), step S3 is executed where the number of partitions is calculated when the stitch data 36 is divided, according to the partition 35 size obtained in step S2. According to the result of the calculation, the number of partitions R, that is, the number of partitions 35 constituting the stitch data 36, the number of rows M, that is, the number of partitions 35 in the vertical direction in the stitch data 36, and the number of columns N, that is, the number of partitions 35 in the horizontal direction in the stitch data 36 are stored into the RAM 30, and the process proceeds to step S4.

By way of concrete example, referring to FIG. 4, when the stitch data 36 is divided into partitions 35, the number of the partitions R=25, the number of rows M=5, the number of columns N=5 are calculated and stored into the RAM 30.

In step S4, the counters 31, namely, a partitions counter K, a rows counter m, and a columns counter n are initialized. By initializing the counters 31, the partitions counter K, the rows counter m, and the columns counter n are reset to initial values K=1, m=1, and n=1, respectively.

After finishing the step of initializing the counters (S4), the process proceeds to step S5.

In step S5, according to the value of the partitions counter K, a stitch data subdivision 40 for the K-th partition is made. The stitch data subdivision 40 is obtained by dividing the stitch data 36 by the partition 35 size. Dividing the stitch data 36 by the partition 35 is performed as follows. For all stitches that lie on the boundaries of the partition 35 in each stitch comprising the stitch data 36, a stitch is divided into two stitches to either side of the boundary that is a divisional line. Then, all stitches falling within the partition 35 are extracted, arranged in order of stitching. After making the stitch data subdivision 40 (S5), partition position information for the stitch data subdivision 40 is added to the subdivision 40.

Here, the partition position information is explained, referring to FIG. 4. As described above, the stitch data 36 in FIG. 4 is divided into 25 partitions in five rows and five columns. Each partition 35 is assigned a number of 1 to 5 by the rows counter and a number of 1 to 5 by the columns counter. For example, a stitch data subdivision 40 marked up in FIG. 4 is distinguished by column number=3 and row number=2.

In the present embodiment, for easy distinction between the vertical position and horizontal position of a partition, the partition position information for the stitch data subdivisions 40 is expressed in terms of combinations of two alphabet letters; that is, row numbers are mapped to uppercase alphabets and column numbers are mapped to lowercase alphabets. Accordingly, because the marked stitch data subdivision 40 is in the second position from the top and the third position from the left, its partition position information is expressed as "Bc." Such partition position information is added to each stitch data subdivision 40 made in step S5. After adding the stitch data subdivision 40 its partition position information (S6), the process proceeds to step S7.

Figure 6:
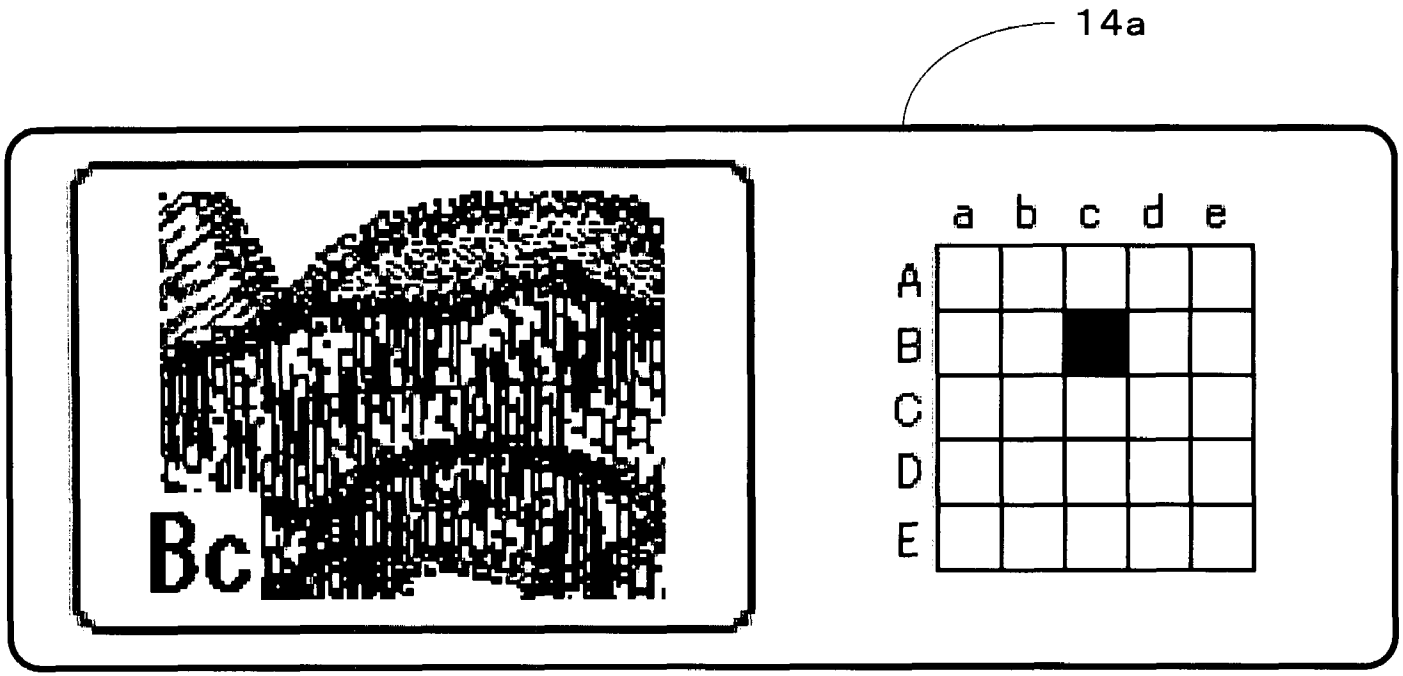
FIG. 6 shows a display example representing a stitch data subdivision on the display panel of an embroidery sewing machine in the present embodiment.

Here, when the stitch data subdivision 40 added its partition position information is stored into the memory card 12 and displayed on the display panel 14*a* provided in place on the bed portion 14 of the embroidery sewing machine 2, a display example which is shown in FIG. 6 is presented on the panel. In consequence, the user can easily know which part of the whole stitch data 36 corresponds to the stitch data subdivision 40 where he or she is going to perform sewing.

In step S7, it is determined whether the value n of the columns counter is equal to the number of columns N. In other words, a decision is made as to whether stitch data subdivisions 40 for all partitions 35 arranged in the horizontal direction on the current row have been made. If the value n of the columns counter is equal to the number of columns N (S7; YES), the process proceeds to step S10. Otherwise, if the value n of the columns counter differs from the number of columns N (S7; NO), the process proceeds to step S8. According to the example shown in FIG. 4, if the value n of the columns counter is any of 1 to 4, the process proceeds to step S8; if the value n of the columns counter has reached 5, the process proceeds to step S10.

If the value n of the columns counter differs from the number of columns N (S7; NO), the value n of the columns counter is incremented by one (S8) and the value K of the partitions counter is also incremented by one. After finishing the step 9, the process returns to step 5.

Consequently, the partition 35 for which to make another stitch data subdivision 40 in the step 5 moves to the next one in the horizontal direction. According to the example shown in FIG. 4, if the stitch data subdivision 40 for the partition 35 that is the second from the top and the third from the left has been made in the step S5 and the steps S8 and S9 have been executed, in the step S5 to which the process returns after finishing the step S9, the partition 35 for which to make another stitch data subdivision 40 moves to the partition that is the second from the top and the fourth from the left (with partition position information: Bd).

Meanwhile, when the value n of the columns counter is equal to the number of columns N (S7; YES), the stitch data subdivisions 40 for all partitions 35 arranged in the horizontal direction on the current row have been made and, therefore, the value n of the columns counter is reset to 1 in step S10 and the process proceeds to step S11.

In step S11, it is determined whether the value m of the rows counter is equal to the number of rows M. In step S11, if the value m of the rows counter is equal to the number of rows M (S11; YES), it indicates that the stitch data subdivisions 40 for all partitions 35 constituting the stitch data 36 have been made.

If the value m of the rows counter differs from the number of rows M (S11; NO), the process proceeds to step S12 and the value m of the rows counter is incremented by one, then the process proceeds to step 9. According to the example shown in FIG. 4, if the stitch data subdivision 40 for the partition 35 that is the second from the top and the fifth from the left (with partition position information: Be) has made in the step S5 and the steps S7 to S12 have been executed, in the step S5 to which the process returns after finishing the step S9, the partition 35 for which to make another stitch data subdivision 40 moves to the partition that is the third from the top and the first from the left (with partition position information: Ca).

Meanwhile, when the value m of the rows counter is equal to the number of rows M (S11; YES), as mentioned above, the stitch data subdivisions 40 for all partitions 35 constituting the stitch data 36 have been made; therefore, the stitch data dividing process terminates.

Figure 5A:
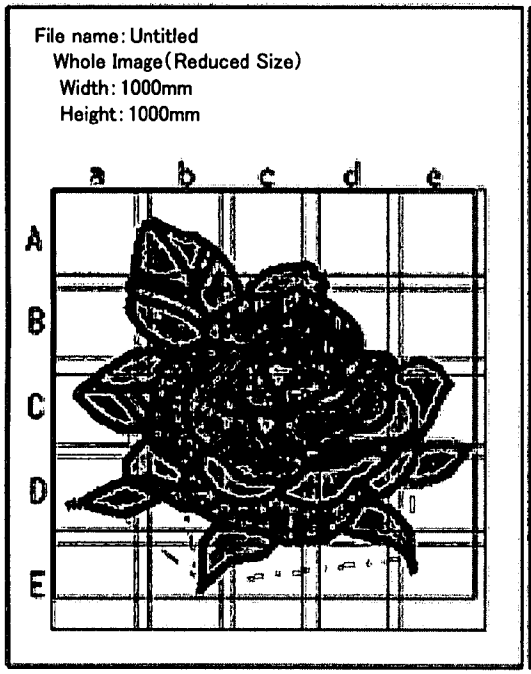
FIG. 5A shows a display example from stitch data divided into the partitions on the display of the embroidery data processing apparatus which manipulates stitch data subdivisions in the present embodiment.
Figure 5B:
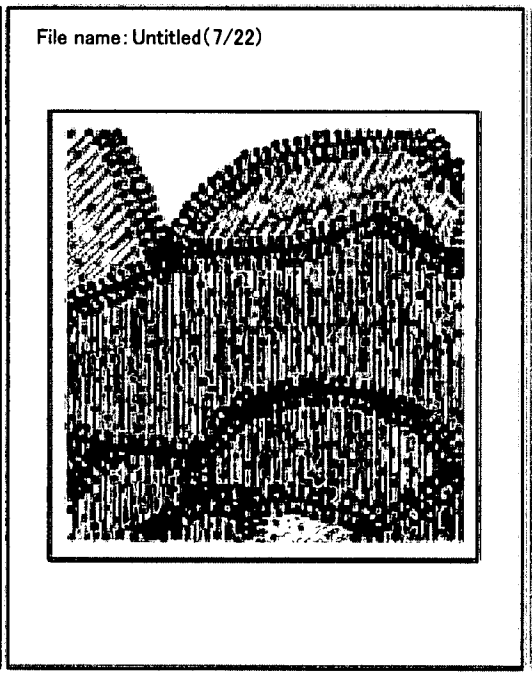
FIG. 5B shows a display example of an enlarged view of a selected stitch data subdivision on the display of the embroidery data processing apparatus which manipulates stitch data subdivisions in the present embodiment.
Figure 5C:
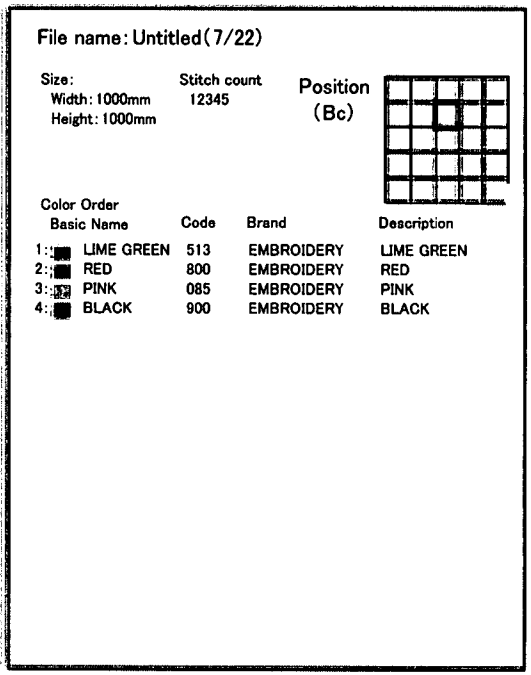
FIG. 5C shows a display example of partition position information for the selected stitch data subdivision on the display of the embroidery data processing apparatus which manipulates stitch data subdivisions in the present embodiment.

The stitch data subdivisions 40 thus created by the stitch data dividing program as described above are displayed on the display 4 connected to the embroidery data processing apparatus; examples of such display are shown in FIGS. 5A through 5C. FIG. 5A shows a display wherein the stitch data 36 is divided into the partitions; FIG. 5B shows an enlarged view of a stitch data subdivision 40 selected; and FIG. 5C shows an example of partition position information for the stitch data subdivision 40 selected. By displaying such pattern and information on the display in this way, detailed information such as the position of a stitch data subdivision 40 in the whole stitch data 36 can be provided appreciably to help the user in performing sewing with ease. This embroidery data processing apparatus 1 allows for connection to a printer 25 (see FIG. 1) and print data is output from the embroidery data processing apparatus 1 to the printer on which it can be printed on a print medium. That is, the display contents shown in FIGS. 5A to 5C can be printed as it is and the information printed is able to provide the same effect as displayed on the display 4.

By the way, the work of installing the embroidery frame 17 in a desired place on the work cloth to be embroidered is difficult for users other than skilled ones. Thus, in the embroidery data processing apparatus 1 of the present embodiment, the size of a partition 35 is set having given dimensions smaller than the size of the maximum workable area of sewing 17*a* which depends on the type of the embroidery frame 17 and a stitch data subdivision 40 for the partition is made.

Figure 7:
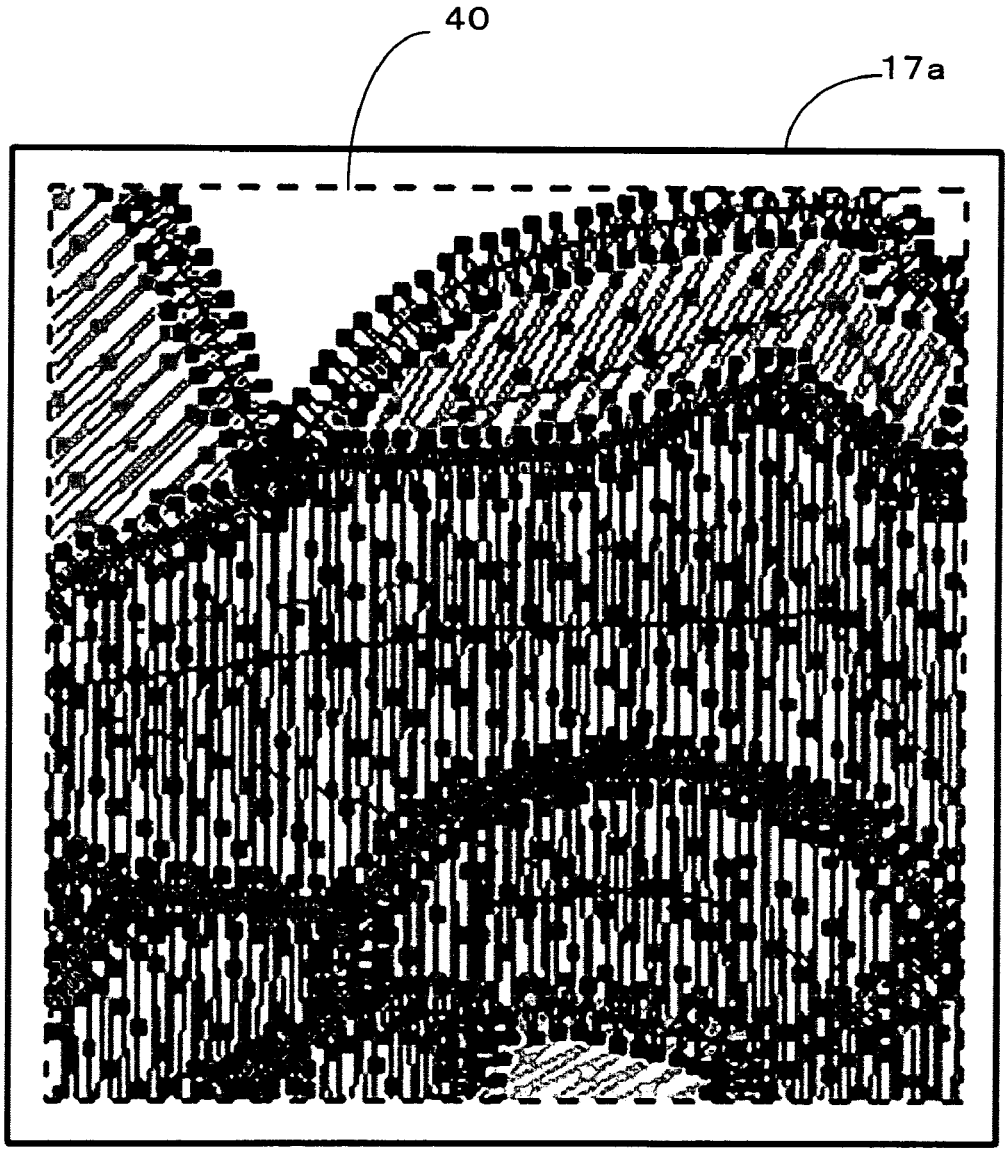
FIG. 7 shows a layout of a stitch data subdivision within the embroidery frame.
Figure 8:
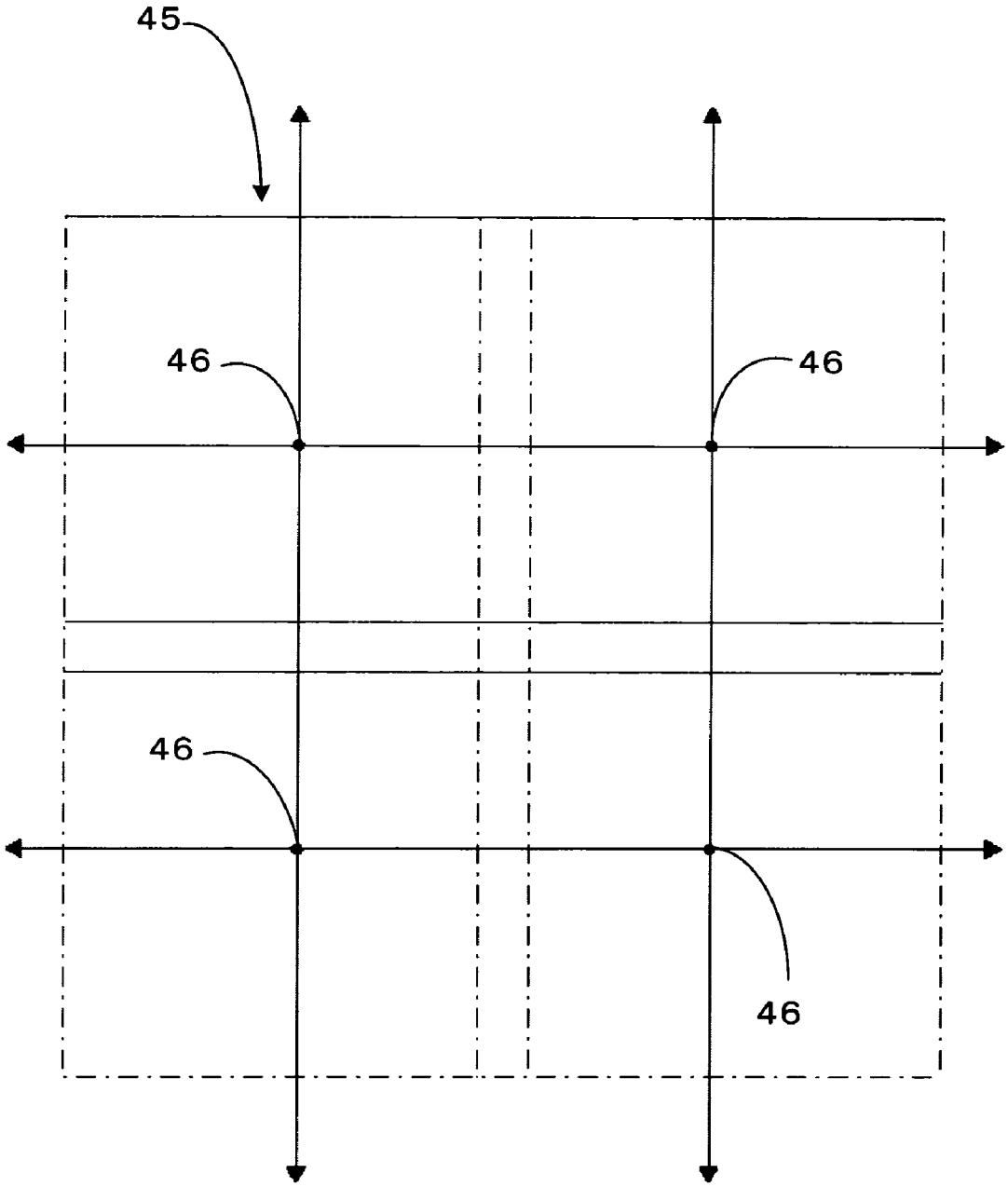
FIG. 8 is an illustration to explain a template of partitions corresponding to stitch data subdivisions in the present embodiment.

As is shown in FIG. 7, by making the stitch data subdivision 40 smaller than the maximum workable area of sewing 17*a*, margins can be provided between the embroidery frame 17 and the stitch data subdivision 40. Consequently, even if the embroidery frame 17 cannot be installed in position on the work cloth to be embroidered when securing the work cloth in the embroidery frame 17 and embroidering an embroidery pattern, the sewing position of the stitch data subdivision 40 can be adjusted within the maximum workable area of sewing 17*a*.

Moreover, because partition size is stored together with its position information, it is possible to make a template 45 of exact-sized partitions corresponding to the stitch data subdivisions 40 and print the template by the printer 25. On this template of partitions 45, positioning markers 46 corresponding to each centers of the multiple partitions 35 are printed.

Consequently, by placing the template 45 of exact-sized partitions on the work cloth to be embroidered, marking at the positioning markers 46 with a chalk pencil or the like, and drawing lines connecting adjacent marks in the horizontal or vertical direction, indicators that aid installing the embroidery frame 17 can be used, so that it will be easy even for unskilled users to install the embroidery frame 17 in the predetermined position on the work cloth to be embroidered.

For the sewing of a large embroidery pattern that requires making stitch data subdivisions 40, in general, it is often practiced to arrange a plurality of paper sheets on which the exact-sized partitions of the embroidery pattern were printed on the work cloth to be embroidered and check the expected completion state of the embroidery before starting the sewing.

Figure 9:
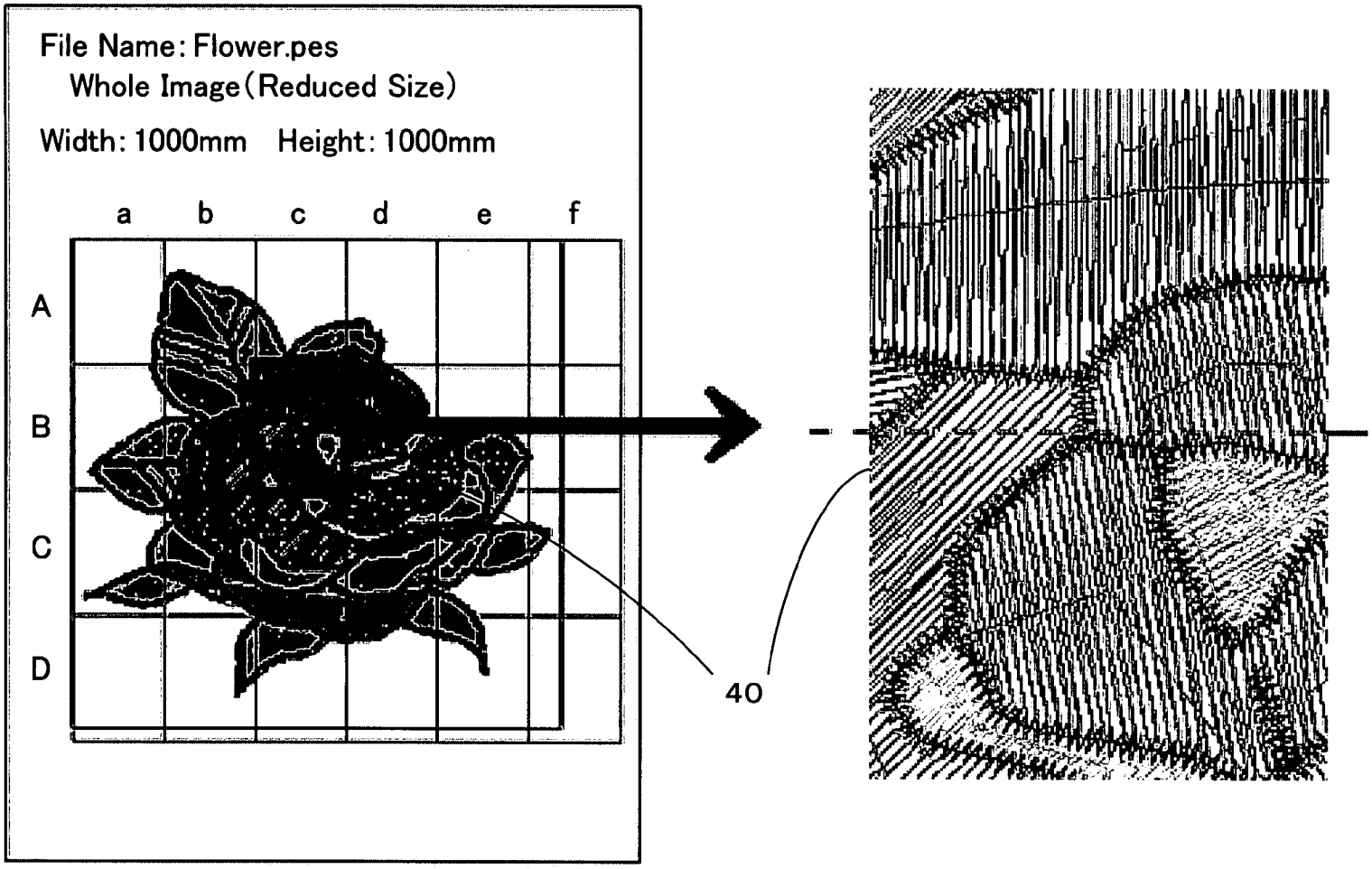
FIG. 9 is an illustration (1) to explain further subdivision of an embroidery data subdivision in the present embodiment.
Figure 10:
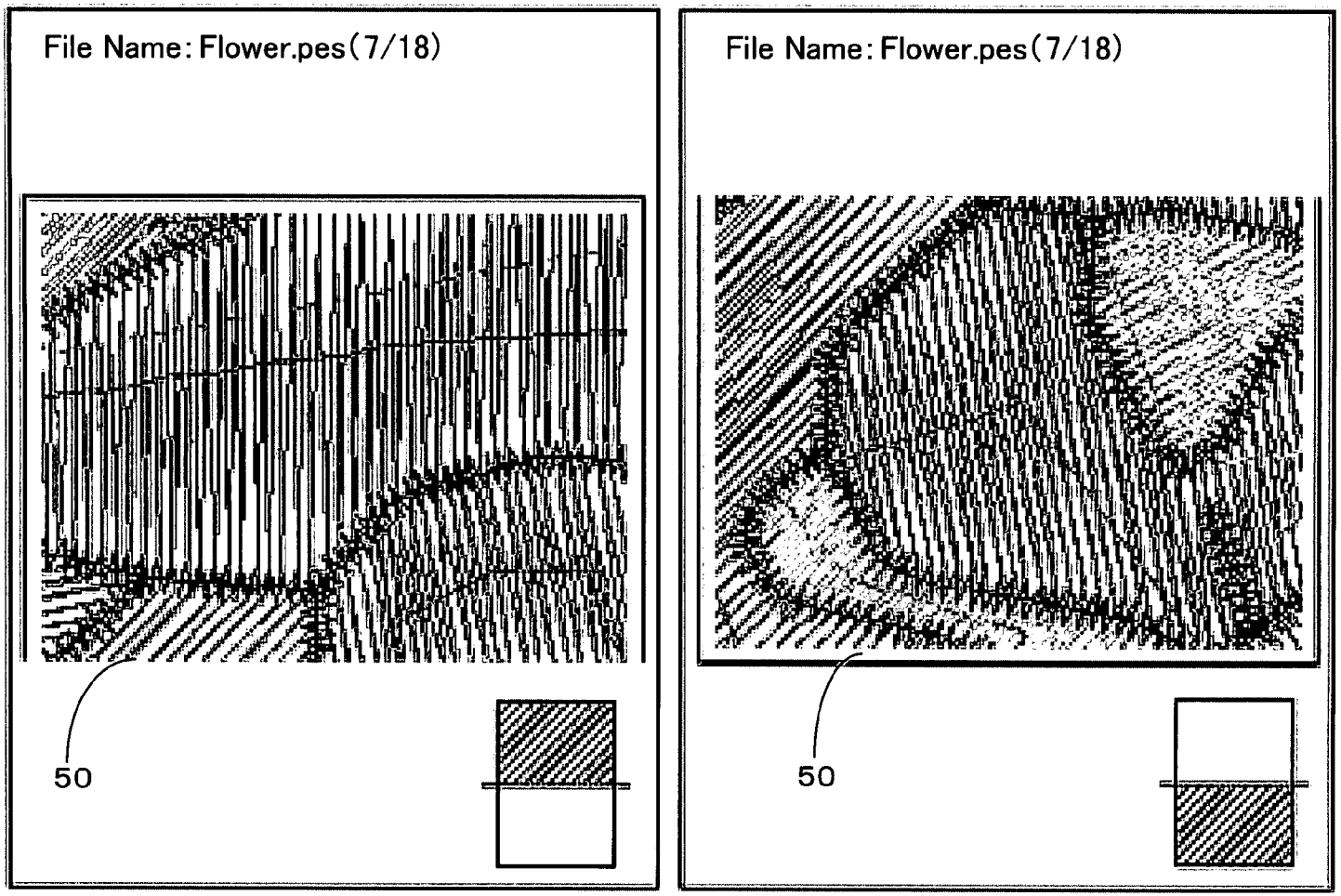
FIG. 10 is an illustration (2) to explain further subdivision of an embroidery data subdivision in the present embodiment.

When attempts are made to print the stitch data subdivisions 40 in full scale on paper in order to check the expected completion of embroidery, it may be impossible to print the stitch data subdivisions 40 in exact size. In such a case, after the size of partitions 35 is newly set according to the paper size, by applying the above stitch data dividing program to the stitch data subdivisions 40, further subdivisions of stitch data 50 into which a stitch data subdivision 40 was further divided can be made (see FIGS. 9 and 10) and the further subdivisions of stitch data 50 can be printed in full scale on paper. At this time, by the stitch data dividing program, the partition position information for the further subdivisions of stitch data 50 in the stitch data subdivisions 40 is also printed (see FIG. 10). Using this information, arranging the sheets of exact-size prints of the further subdivisions on the work cloth to be embroidered can be performed easily.

The embroidery data processing apparatus 1 of the present embodiment displays the stitch data subdivisions 40 made by stitch data dividing program on the display 4 connected to itself. Thus, detailed information such as the position of a stitch data subdivision 40 in the whole stitch data 36 can be provided appreciably to help the user in performing sewing with ease.

The apparatus makes stitch data subdivisions 40 according to the partitions 35 of size that is smaller than the size of the maximum workable area of sewing 17*a* which depends on the type of the embroidery frame 17. This can moderate the accuracy of the work of installing the embroidery frame in predetermined position on the work cloth to be embroidered, which requires a lot of skill. Even in a case where a low-skill user failed to install the embroidery frame 17 in the predetermined position on the work cloth to be embroidered, the sewing position of a stitch data subdivision 40 can be adjusted within the maximum workable area of sewing 17*a*.

In addition to displaying or printing the stitch data subdivisions 40 made, the apparatus makes the template 45 of exact-sized partitions with positioning markers 46 and this template can be printed by the printer 25. By placing the template 45 of exact-sized partitions on the work cloth to be embroidered, marking at the positioning markers 46 with a chalk pencil or the like, and drawing lines connecting adjacent marks in the horizontal or vertical direction, indicators for installing the embroidery frame 17 can be used, so that it will be easy even for unskilled users to install the embroidery frame 17 in the predetermined position on the work cloth to be embroidered.

When attempts are made to print the stitch data subdivisions 40 in full scale on paper in order to check the expected completion of embroidery, it may be impossible to print the stitch data subdivisions 40 in exact size. In such a case, after the size of partitions 35 is newly set according to the paper size, by applying the above stitch data dividing program to the stitch data subdivisions 40, further subdivisions of stitch data 50 into which a stitch data subdivision 40 was further divided can be made and the further subdivisions of stitch data 50 can be printed in full scale on paper.

At this time, by the stitch data dividing program, the partition position information for the further subdivisions of stitch data 50 in the stitch data subdivisions 40 is also printed. Using this information, arranging the sheets of exact-size prints of the further subdivisions on the work cloth to be embroidered can be performed easily, and the expected completion of the whole embroidery pattern can be checked easily.

Furthermore, this stitch data dividing program can be stored on a storage medium such as the flexible disk 7*a* and CD-ROM and read from the medium into a computer or the like. By this program loading, even a device for processing embroidery data in which the stitch data dividing program is not installed is able to provide the same effect as the embroidery data processing apparatus 1 of the present embodiment.

The present invention may be embodied in other specific forms without departing from the spirit or essential characteristics thereof.

For instance, while, in the present embodiment, partition 35 size data is obtained by reading that data stored in advance in the ROM 21, flexible disk 7*a*, or CD-ROM or by user input with the keyboard 5 and mouse 6, the stitch data dividing program may be executed on the embroidery sewing machine 2, wherein the size of the embroidery frame 17 is automatically recognized by the embroidery sewing machine 2 and the partition size may be set accordingly or a desired setting of the partition size may be selected from a plurality of settings.

Moreover, while, in the present embodiment, stitch data subdivisions are made by dividing stitch data, image data or graphic data that underlies the stitch data may be divided and stitch data subdivisions may be made, based on the divided image data or graphic data.

Although, in the present embodiment, the partition position information for a stitch data subdivision consists entirely of the partition positions in the vertical and horizontal directions in the whole stitch data, the embodiment can be modified such that relative position information from the partition where sewing has been performed most recently is added to the above information, which poses no problem.

Although, in the present embodiment, further subdivisions of stitch data 50 are made if it is impossible to print the stitch data subdivisions 40 in full scale on paper, the embodiment may be modified such that print data corresponding to the stitch data subdivisions 40 may be divided into subdivisions, thus making print data subdivisions.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An apparatus for processing embroidery data including a control unit which manipulates embroidery data by which the sewing of an embroidery pattern is performed using an embroidery sewing machine, wherein the control unit comprises:

a processor which performs the following process comprising:

a process of obtaining partition information for dividing the embroidery data into a plurality of partitions, based on a predetermined area of sewing which is determined, depending on the type of an embroidery frame specified by selecting the type of the embroidery frame;

a process of making embroidery data subdivisions by dividing the embroidery data into subdivisions, according to the partition information; and a process of generating partition position information that indicates the position of the embroidery data subdivisions in the whole embroidery data; and a display device which displays a pattern layout and the location of an embroidery data subdivision in the whole embroidery data, based on the partition position information for the embroidery data subdivisions.

2. The apparatus for processing embroidery data according to claim 1, wherein the processor performs the process of making embroidery data subdivisions by dividing the embroidery data by the partition bounds which are obtained as the partition information and which are of dimensions somewhat less than the predetermined area of sewing.

3. The apparatus for processing embroidery data according to claim 1, wherein the processor performs a process of adding the partition position information to the embroidery data subdivisions.

4. The apparatus for processing embroidery data according to claim 1, wherein the partition position information is image data showing the partition position for each subdivisions.

5. The apparatus for processing embroidery data according to claim 1, wherein the partition position information is code data comprised at least either of the partition position in a vertical direction and the partition position in a horizontal direction in the whole embroidery data.

6. An apparatus for processing embroidery data including a control unit which manipulates embroidery data by which the sewing of an embroidery pattern is performed using an embroidery sewing machine and allowing for connection to a printer, wherein the control unit comprises a processor which performs the following process comprising:

a process of obtaining partition information that specifies the bounds of a partition for a plurality of partitions into which the embroidery data is divided;

a process of making embroidery data subdivisions by dividing the embroidery data into subdivisions, according to the partition information; and a process of making a template of partitions with markers indicating relative positions of the embroidery data subdivisions in the whole embroidery data, based on the embroidery data subdivisions, and generating print data for printing the template by the printer.

7. The apparatus for processing embroidery data according to claim 6, wherein the processor performs the process of obtaining partition information for dividing the embroidery data into a plurality of partitions, based on a predetermined area of sewing which is determined, depending on the type of an embroidery frame specified by selecting the type of the embroidery frame.

8. The apparatus for processing embroidery data according to claim 7, wherein the processor performs the process of making embroidery data subdivisions by dividing the embroidery data by the partition bounds which are obtained as the partition information and which are of dimensions somewhat less than the predetermined area of sewing.

9. An apparatus for processing embroidery data including a control unit which manipulates embroidery data by which the sewing of an embroidery pattern is performed using an embroidery sewing machine and allowing for connection to a printer, wherein the control unit comprises a processor which performs the following process comprising:

a process of obtaining partition information that specifies the bounds of a partition for a plurality of partitions into which the embroidery data is divided;

a process of making embroidery data subdivisions by dividing the embroidery data into subdivisions, according to the partition information;

a process of generating print data for printing pattern figure sections corresponding to the embroidery data subdivisions, based on the embroidery data subdivisions using the printer;

a process of making print data subdivisions for a part of the embroidery data subdivisions, if it is impossible to print the whole print data on the print medium, when printing the print data in full scale by the printer; and a process of adding print subdivision position information indicating the position of the print data subdivisions in the whole print data to the print data subdivisions.

10. The apparatus for processing embroidery data according to claim 9, wherein the processor performs the process of obtaining partition information for dividing the embroidery data into a plurality of partitions, based on a predetermined area of sewing which is determined, depending on the type of an embroidery frame specified by selecting the type of the embroidery frame.

11. The apparatus for processing embroidery data according to claim 10, wherein the processor performs the process of making embroidery data subdivisions by dividing the embroidery data by the partition bounds which are obtained as the partition information and which are of dimensions somewhat less than the predetermined area of sewing.

12. An apparatus for processing embroidery data including a control unit which manipulates embroidery data by which the sewing of an embroidery pattern is performed using an embroidery sewing machine and allowing for connection to a printer which prints on a print medium, wherein the control unit comprises a processor which performs the following process comprising:

a process of obtaining partition information that specifies the bounds of a partition for a plurality of partitions into which the embroidery data is divided;

a process of making embroidery data subdivisions by dividing the embroidery data into subdivisions, according to the partition information;

a process of making print data subdivisions for printing pattern figure pieces corresponding to a part of pattern figure sections by the printer, if it is impossible to print the whole pattern figure section on the print medium, when printing the pattern figure sections corresponding to the embroidery data subdivisions in full scale by the printer; and a process of adding print subdivision position information indicating the position of the pattern figure pieces in the whole design layout section to the print data subdivisions.

13. The apparatus for processing embroidery data according to claim 12, wherein the processor performs the process of obtaining partition information for dividing the embroidery data into a plurality of partitions, based on a predetermined area of sewing which is determined, depending on the type of an embroidery frame specified by selecting the type of the embroidery frame.

14. The apparatus for processing embroidery data according to claim 13, wherein the processor performs the process of making embroidery data subdivisions by dividing the embroidery data by the partition bounds which are obtained as the partition information and which are of dimensions somewhat less than the predetermined area of sewing.

15. A program stored on a computer readable medium for processing embroidery data which is executed on a control unit which manipulates the embroidery data by which the sewing of an embroidery pattern is performed using an embroidery sewing machine, wherein the program comprises instructions for causing a processor installed in the control unit to perform the following process comprising:

a step of obtaining partition information for dividing the embroidery data into a plurality of partitions, based on a predetermined area of sewing which is determined, depending on the type of an embroidery frame specified by selecting the type of the embroidery frame;

a step of making embroidery data subdivisions by dividing the embroidery data into subdivisions, according to the partition information;

a step of generating partition position information that indicates the position of the embroidery data subdivisions in the whole embroidery data; and a step of adding the partition position information to the embroidery data subdivisions.

16. The computer program for processing embroidery data according to claim 15, wherein the program causes the processor installed in the control unit to perform the step of making embroidery data subdivisions by dividing the embroidery data by the partition bounds which are obtained as the partition information and which are of dimensions somewhat less than the predetermined area of sewing.

17. A program stored on a computer readable medium for processing embroidery data which is executed on a control unit which manipulates the embroidery data by which the sewing of an embroidery pattern is performed using an embroidery sewing machine and print data which is sent to and printed by a printer, wherein the program comprises instructions for causing a processor installed in the control unit to perform the following process comprising:

a step of obtaining partition information that specifies the bounds of a partition for a plurality of partitions into which the embroidery data is divided;

a step of making embroidery data subdivisions by dividing the embroidery data into subdivisions, according to the partition information; and a step of making a template of partitions with markers for setting a cloth aligned with the partitions, when embroidering the whole embroidery data based on the embroidery data subdivisions, and generating print data for printing the template by the printer.

18. The computer program for processing embroidery data according to claim 17, wherein the program causes the processor installed in the control unit to perform the step of obtaining partition information for dividing the embroidery data into a plurality of partitions, based on a predetermined area of sewing which is determined, depending on the type of an embroidery frame specified by selecting the type of the embroidery frame.

19. The computer program for processing embroidery data according to claim 18, wherein the program causes the processor installed in the control unit to perform the step of making embroidery data subdivisions by dividing the embroidery data by the partition bounds which are obtained as the partition information and which are of dimensions somewhat less than the predetermined area of sewing.

20. A program stored on a computer readable medium for processing embroidery data which is executed on a control unit which manipulates the embroidery data by which the sewing of an embroidery pattern is performed using an embroidery sewing machine and print data which is sent to and printed by a printer, wherein the program comprises instructions for causing a processor installed in the control unit to perform the following process comprising:

a step of obtaining partition information that specifies the bounds of a partition for a plurality of partitions into which the embroidery data is divided;

a step of making embroidery data subdivisions by dividing the embroidery data into subdivisions, according to the partition information;

a step of generating print data for printing pattern figure sections corresponding to the embroidery data subdivisions, based on the embroidery data subdivisions, using the printer;

a step of making print data subdivisions for a part of the embroidery data subdivisions, if it is impossible to print the whole print data on the print medium, when printing the print data in full scale by the printer; and a step of adding print subdivision position information indicating the position of the print data subdivisions in the whole print data to the print data subdivisions.

21. The computer program for processing embroidery data according to claim 20, wherein the program causes the processor installed in the control unit to perform the step of obtaining partition information for dividing the embroidery data into a plurality of partitions, based on a predetermined area of sewing which is determined, depending on the type of an embroidery frame specified by selecting the type of the embroidery frame.

22. The computer program for processing embroidery data according to claim 21, wherein the program causes the processor installed in the control unit to perform the step of making embroidery data subdivisions by dividing the embroidery data by the partition bounds which are obtained as the partition information and which are of dimensions somewhat less than the predetermined area of sewing.

23. A program stored on a computer readable medium for processing embroidery data which is executed on a control unit which manipulates the embroidery data by which the sewing of an embroidery pattern is performed using an embroidery sewing machine and print data which is sent to and printed by a printer, wherein the program comprises instructions for causing a processor installed in the control unit to perform the following process comprising:

a step of obtaining partition information that specifies the bounds of a partition for a plurality of partitions into which the embroidery data is divided;

a step of making embroidery data subdivisions by dividing the embroidery data into subdivisions, according to the partition information;

a step of making print data subdivisions for printing pattern figure pieces corresponding to a part of pattern figure sections by the printer, if it is impossible to print the whole pattern figure section on the print medium, when printing the pattern figure sections corresponding to the embroidery data subdivisions in full scale by the printer; and a step of adding print subdivision position information indicating the position of the pattern figure pieces in the whole pattern figure section to the print data subdivisions.

24. The computer program for processing embroidery data according to claim 23, wherein the program causes the processor installed in the control unit to perform the step of obtaining partition information for dividing the embroidery data into a plurality of partitions, based on a predetermined area of sewing which is determined, depending on the type of an embroidery frame specified by selecting the type of the embroidery frame.

25. The computer program for processing embroidery data according to claim 24, wherein the program causes the processor installed in the control unit to perform the step of making embroidery data subdivisions by dividing the embroidery data by the partition bounds which are obtained as the partition information and which are of dimensions somewhat less than the predetermined area of sewing.

* * * * *